United States Patent [19]

Nixon, Jr. et al.

[11] Patent Number: 4,777,782

[45] Date of Patent: Oct. 18, 1988

[54] APPARATUS AND METHODS FOR MAKING DIFFERENTIALLY-CONDITIONED PACKAGE PAIRS

[75] Inventors: Henry M. Nixon, Jr., Wayne; George W. Anderson, Little Falls; John A. Giordano, Paterson, all of N.J.

[73] Assignee: Mahaffy & Harder Engineering Co., Fairfield, N.J.

[21] Appl. No.: 58,587

[22] Filed: Jun. 5, 1987

[51] Int. Cl.[4] ..... B65B 31/04

[52] U.S. Cl. ..... 53/433; 53/511; 53/202; 426/316; 426/404; 426/418

[58] Field of Search ..... 53/433, 511, 202; 426/316, 404, 418

[56] References Cited

U.S. PATENT DOCUMENTS

| | | | |
|---|---|---|---|
| 3,061,984 | 11/1962 | Mahaffy | 53/433 |
| 3,129,545 | 4/1964 | Sloan | 53/511 |
| 3,343,332 | 9/1967 | Mahaffy | 53/433 |
| 3,498,021 | 3/1970 | Harder | 53/511 |
| 3,744,210 | 7/1973 | O'Lenick | 53/433 |
| 3,832,828 | 9/1973 | Martin | 53/511 |
| 4,137,688 | 2/1979 | Utz | 53/511 X |

*Primary Examiner*—John Sipos

*Attorney, Agent, or Firm*—Parmelee, Bollinger & Bramblett

[57] ABSTRACT

Different products are hermetically sealed in separate but integrally adjoining packages to form package pairs or what might be called "dual" packages. All of the packages are made from two continuous sheets of plastic packaging material, and the separate packages of each pair are differentially-conditioned by differential evacuation and/or gassing to different pressure levels. A continuous series of filled side-by-side containers formed from one sheet of packaging material is conveyed in two parallel rows into a sealing region where a cover sheet is laid over the containers to form packages. A group of the packages is stopped in the sealing region, and are clamped and partially sealed around the peripheries of the individual packages. The individual side-by-side units of the package pairs are differentially conditioned as to vacuum pressure or gas pressure or composition through aligned openings between adjacent containers in each of the parallel rows. The aligned openings and the remainder of the peripheries around the package then are sealed, and the completed package pairs are removed from the sealing region. The differential conditioning of the package pairs may be by way of differential evacuation, or evacuation followed by backfilling the packages with different pressures of gas, or other combinations.

5 Claims, 2 Drawing Sheets

SEAL REGION

APPARATUS AND METHODS FOR MAKING DIFFERENTIALLY-CONDITIONED PACKAGE PAIRS

BACKGROUND OF THE INVENTION

1. Field of the Invention

This invention relates to vacuum packaging methods and apparatus. More particularly, this invention relates to the production of integral package pairs in which different products are simultaneously packaged in adjoining packages to provide different atmospheric conditioning for the products during the package formation.

2. Description of the Prior Art

Evacuated packages formed of heat-sealable flexible packaging materials with a low rate of gas permeability have found wide acceptance because of their extended shelf life as compared to conventional packages. Where atmospheric pressure surrounding a vacuum package could cause mechanical damage to the packaged product or to its container, inert gases such as nitrogen may be introduced into the package after evacuation to reduce or eliminate the pressure differential to which the package walls would otherwise be subjected. In producing such packages automatically the packages may be partially sealed before the evacuating or gassing operations are performed.

The packages are often formed from two continuous sheets of packaging material. One sheet may be formed into cup-shaped containers, and the other sheet laid down as a cover or top over the containers. An aperture may be formed adjacent the container for evacuation and possible subsequent back-filling with gas. A web-lifter may be provided in the machine sealing station which tents the top web to improve the evacuation and/or gassing of the packages. The aperture opening may be located between two adjacent containers which can be processed in the same manner because of the common opening. More detail is available in U.S. Pat. No. 3,061,984 to R. A. Mahaffy which is assigned to the Assignee of the present invention.

SUMMARY OF THE INVENTION

In accordance with the invention, there is provided improved packaging techniques for forming dual packages in the form of integral package pairs wherein the separate package units of each pair are differentially conditioned simultaneously as by being provided with, for example, different vacuum levels, different gas pressures, or different gases. The separate packages of the pairs are arranged in parallel rows and carry different products which must be packaged under different evacuation or gassing conditions. This invention provides new and improved means for packaging such different products in adjoining packages with different amounts of evacuation or gassing to the product being packaged.

In one illustrative embodiment thereof, different products are packaged under different conditions at the same time by apparatus conveying a continuous series of filled side-by-side cup-like containers, made from a single sheet of packaging material, in two parallel rows into a sealing region. The containers of one row carry one type of product, and the containers of the other row carry a different product. A second sheet of packaging material is laid down over the filled containers to make packages. A group of the packages is stopped in a sealing region of the apparatus, clamped and partially sealed around their peripheries. Then, differential atmospheres are created in the individual units of the package pairs through aligned openings between adjacent packages in the respective rows. Thereafter, the openings and the remainder of the package peripheries are sealed. The group of completed packages are then removed from the sealing region and the process repeated. The differential atmosphere in the individual units of each package pair may be in the form of differential evacuation, or evacuation followed by differential gassing, or other combinations.

Advantageously, two or more packages are produced at the same time with different pressure levels or internal atmospheres, including, where appropriate, different gas compositions. An illustrative application of this type of packaging would be the combination of cooked pasta and sauce; the sauce package would ideally use a full vacuum while the pasta package would have less than full vacuum to prevent crushing or squeezing the pasta and destroying its quality.

Other objects, aspects and advantages of the invention will be pointed out in, or apparent from, the following detailed description of a preferred embodiment of the invention, considered together with the accompanying drawings.

DESCRIPTION OF A PREFERRED EMBODIMENT

Figure 1:
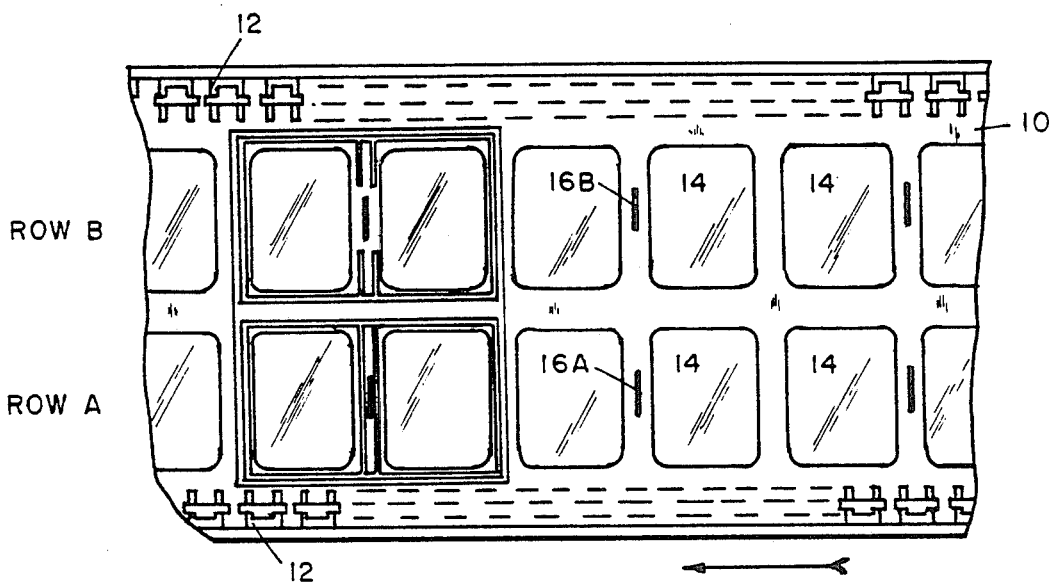
FIG. 1 is a plan view of a part of a packaging machine embodying the present invention, with portions above the web line removed.
Figure 2:
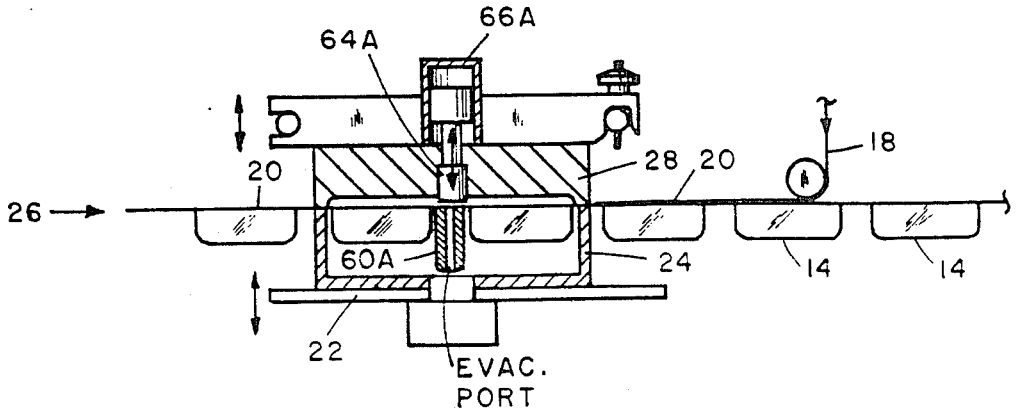
FIG. 2 is a side elevation of the machine shown in FIG. 1.

Referring now to FIGS. 1 and 2, there is shown a continuous sheet of plastic packaging material 10 (flexible or semi-rigid) being conveyed to the left by a chain 12 carrying the usual web clamps which grip the side edges of the sheet. The sheet 10 is formed into cup-shaped containers 14 loaded with product (not shown), and arranged in two side-by-side rows A and B. Evacuation openings 16A and 16B are cut through the plastic between successive container pairs, in the machine direction (i.e. fore-and-aft). As shown in FIG. 2, a second continuous web of plastic packaging material 18 is laid down over the first web 10 to cover the filled containers 14 and thereby form packages 20.

The conveyor chain 12 is driven with an intermittent indexing movement. In each advancing step, a group of four packages 20 is moved into a seal region 22 of the apparatus. In this region, there is a sealing die 24 below the web line 26, and a sealing head 28 above the web line. These two units reciprocate vertically in synchronism, and come together (as shown in FIG. 2) to clamp the peripheries of the group of four packages then stopped in the seal region 22.

Figure 3:
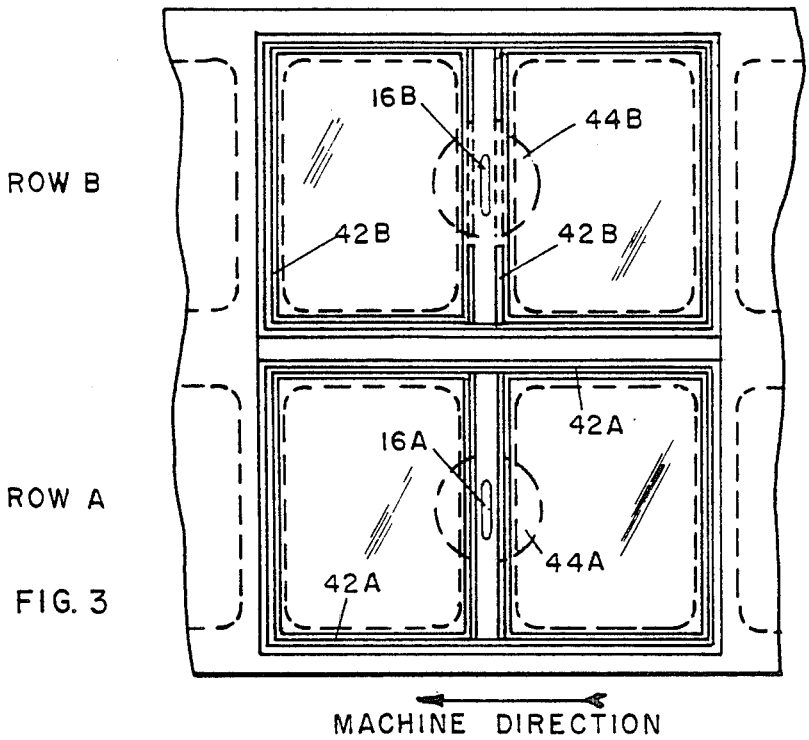
FIG. 3 is a plan view showing details of the sealing region.

The sealing die 24 and the sealing head 28 cooperate, when in closed position, to form two separate sealed chambers over the package rows A and B respectively, and to clamp the packages firmly within those chambers. The chambers are identified in FIG. 4 with the numerals 30A, 30B. As shown in FIG. 3, each chamber contains two packages, adjacent in the fore-and-aft direction, with an evacuation opening 16A,B between the two.

The sealing head 28 includes two sets of initial sealing bars 40A, 40B which form by heat and pressure initial seals 42A, 42B (see particularly the upper portion of FIG. 3) partially around the periphery of all four packages then in the sealing chambers. This initial seal leaves an open space 44A, 44B around each evacuation opening 16A,B, to provide for communication through that opening to the interiors of the two fore-and-aft adjoining package sets. A web-lifter 46A,B (FIG. 4) is incorporated to automatically push up the top web into a tent-like formation to provide for effective transfer of air during evacuation, and of gas during a subsequent gassing operation. Sealing methods other than heat and pressure can be used where appropriate, although heat and pressure will be used in most applications.

Figure 4:
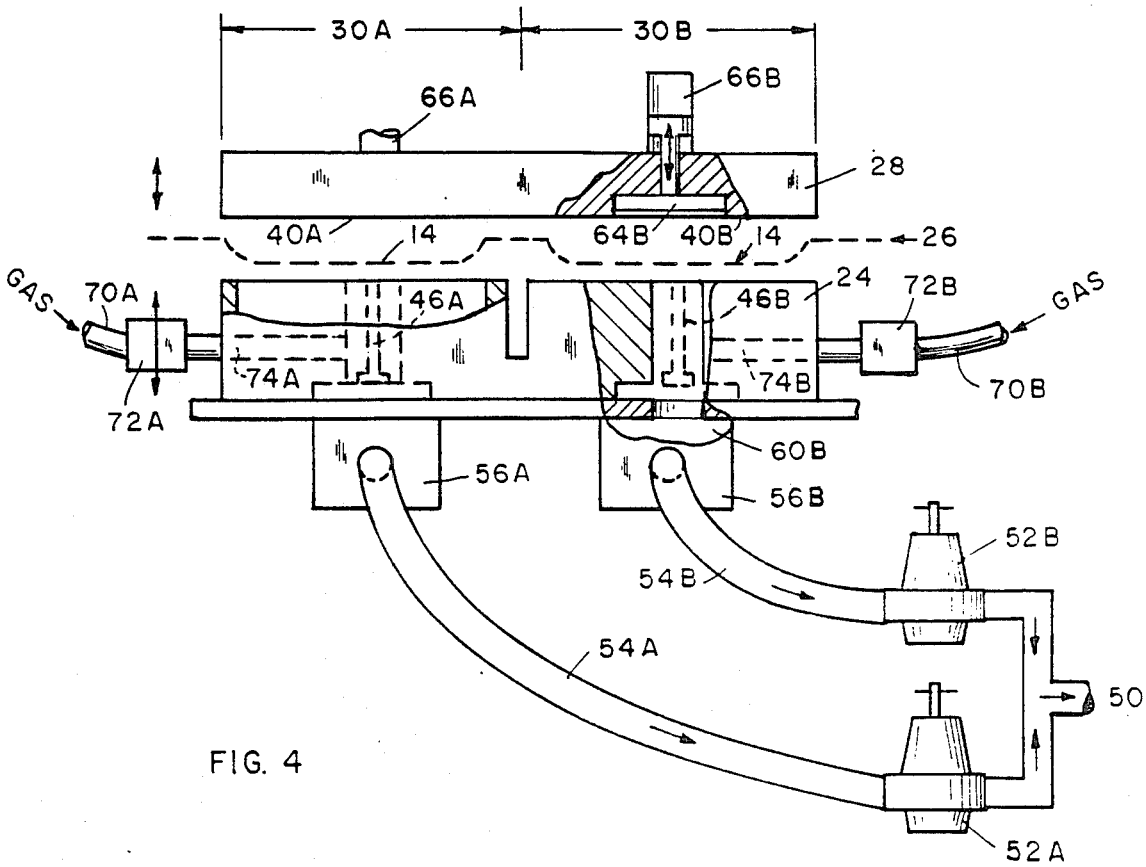
FIG. 4 is an elevational view of the machine of FIG. 1 with the packages removed, as seen looking in the machine direction.

With continued reference to FIG. 4, a source of vacuum 50 is connected through vacuum regulators 52A, 52B and flexible hoses 54A, 54B to respective vacuum valves 56A, 56B beneath the chambers 30A, 30B respectively. These valves communicate through corresponding ports in the sealing die 24 to the lower interior portions of the respective chambers. The chambers are sealingly isolated one from the other within the sealing die and sealing head structure.

In operation, when the chambers 30A, 30B are closed and the initial seals 42A,B made, valves 56A, 56B are opened to provide vacuum through the vacuum regulators 52A,B from the vacuum source 50. The vacuum is applied through ports 60A,B and the corresponding slots 16A, 16B into the interior of the packages 20 then in the seal region 22. The packages all are evacuated to pre-set vacuum levels controlled by the vacuum regulators 52A,B. In the preferred embodiment described herein, the vacuum regulators are pre-set to provide different vacuum levels. Thus, the packages in row B are evacuated to a different vacuum level from those in row A.

At the end of the period required for evacuation, final seal bars 64A,B are moved by pneumatic cylinders 66A,B down against the remaining open (unsealed) areas 44A,B as seen in FIG. 3. These final seal bars seal by heat and pressure around the evacuation slots 16A,B, thereby completely sealing all four packages of the group. The lower section of FIG. 3 (row A) illustrates a final-sealed package as sealed by the procedure just described, while in the upper section (row B) the area 44B is shown unsealed simply to illustrate how the process works. In normal operation, both areas 44A,B would be completely sealed at approximately the same time.

For certain applications, the vacuum level supplied to both chambers 30A,B may be identical, and the differential vacuum in the package groups may be achieved by actuating the final seal bars for the two chambers before completion of the normal evacuation period, i.e. so that the final seal bar for at least one of the chambers is actuated before the vacuum in that chamber has reached the level of the vacuum being supplied. For example, row A may be limited to a vacuum level higher that that supplied simply by actuating the final seal bar before the end of the normal period for evacuation, while row B is allowed to become fully evacuated to the limit of the vacuum supply before actuating its final seal bar.

After evacuation and before the final seal bar descends, the package may be back-filled with gas. The gas supply means may for example comprise flexible hoses 70A,B connecting to a controlled gas source, and leading through valves 72A,B and passageways 74A,B to the ports 60A,B and hence to the openings 16A,B. The gas pressures supplied to rows A and B may be differentially controlled, for example to achieve a gas pressure in the packages of row A which is different from that in the packages of row B. Such differential control may, when appropriate, be used to supply gases of different composition to the two sets of packages, i.e. in rows A and B.

Once the package group consisting of the four packages 20 in the seal region 22 has been evacuated, back-filled with gas (when appropriate) and sealed, the chambers 30A,B are vented to the atmosphere. The sealing die 24 and sealing head 28 then are moved away from the packages. All four packages of the group then are indexed out and a new group is indexed into position in the seal region 22, and the cycle is repeated.

The completed (sealed) packages are cut apart in a cutting area of the machine. For this purpose, the fore-and-aft package sets (two in each set) are cut apart, i.e. through the region containing the evacuation slots 16A,B. The side-by-side adjoining packages however remain as integral package pairs or a "dual" package set, in which the separate packages are differentially conditioned, as by having different vacuum levels, or different gas levels, or different gas compositions.

As has been pointed out, the differential pressure in the integrally connected packages may be provided by back-filling with gas, in which case the vacuum source 50 may be augmented with a gas supply or a plurality of gas supplies which may be fed through different valves to row A or B to provide a differential gas pressure, or different gas compositions for each row. For example, one package might be back-filled with $CO_2$ while the other package might be back-filled with nitrogen, depending on the product and the purpose of the back-filling. In addition, a combination may be provided to evacuate both packages and back-fill one with gas, leaving the other as a pure vacuum package without gas.

The present invention provides automatic packaging machinery capable of supplying two or multiples of two packages which are differentially-conditioned, as by having different pressure levels, either vacuum or gas, or a combination of each, or different gas compositions. The method of the present invention is particularly useful when packaging two related but different types of products in connected (adjoining) packages. One example of this is packaging a pasta in one package and the sauce for the pasta in the adjoining package of the pair. The sauce could be under maximum vacuum while the pasta could be under lesser vacuum to prevent crushing or squeezing of the product. In accordance with the invention, separate production lines do not have to be set-up to process each product. The entire process may be carried out simultaneously in the same machine with consistent results.

Although specific preferred embodiments of the invention have been described hereinabove in detail, it is desired to emphasize that this has been for the purpose of illustrating the invention, and should not be considered as necessarily limitative of the invention, it being understood that many modifications can be made by those skilled in the art while still practicing the invention claimed herein.

What is claimed is:

1. The method of packaging different products in the respective individual packages of integrally adjoining package pairs, the package pairs being differentially-conditioned while the individual packages of the pair are completed at the same time, said method comprising the steps of:

conveying a continuous series of product-filled containers in at least two parallel rows and wherein pairs of transversely adjacent containers are filled with different products;

covering said containers to form packages;

moving a group of said packages into a sealing region, said group including at least two integrally adjoining package pairs formed from said pairs of transversely adjacent containers;

clamping and initially partially sealing each of said groups of packages around the peripheries thereof;

simultaneously differentially-conditioning the interiors of two transverse pairs of adjacent packages one from the other through respective evacuation openings aligned transversely between respective pairs of transversely adjacent packages leading into the package interiors;

sealing said openings to effect a final seal of the individual packages of said pairs of packages in their differentially-conditioned state; and removing said sealed packages from said sealing region.

2. The method as claimed in claim 1, wherein the containers of said integrally-adjoining package pairs are formed from a single sheet of plastic packaging material.

3. The method as claimed in claim 1, wherein said two package pairs are disposed one behind the other in the direction of movement of said filled containers, thereby forming two sets of fore-and-aft packages with two packages in each set; and differentially-conditioning the fore-and-aft packages of each set together through a common evacuation opening.

4. The method as claimed in claim 1, wherein said package pairs are covered by a sheet of plastic packaging material; and lifting up said sheet of material over both of said evacuation openings during the differential conditioning thereof.

5. The method of packaging different products in the respective individual packages of integrally adjoining package pairs, the package pairs being differentially-conditioned while the individual packages of the pair are being completed at the same time, said method comprising the steps of:

conveying a continuous series of filled-containers in at least two parallel rows and wherein pairs of transversely adjacent containers are filled with different products;

covering said containers to form packages;

moving a group of said packages into a sealing region, said group including at least two integrally-adjoining package pairs formed from said pairs of transversely adjacent containers;

clamping and initially partially sealing each of said group of packages around the peripheries thereof;

simultaneously differentially-conditioning the interiors of said two transverse pairs of adjacent packages one from the other through respective evacuation openings leading into the package interiors;

completing the hermetic sealing of said package pairs including sealing said openings to effect a final seal of the individual packages of said integrally-adjoining pairs of packages in their differentially-conditioned state; and removing said sealed packages from said sealing region.

* * * * *